US006705286B1

(12) United States Patent
Light et al.

(10) Patent No.: US 6,705,286 B1
(45) Date of Patent: Mar. 16, 2004

(54) METHOD AND SYSTEM FOR MINIMIZING TORQUE INTERVENTION OF AN ELECTRONIC THROTTLE CONTROLLED ENGINE

(75) Inventors: Dennis A. Light, Monroe, MI (US); Jeffrey Allen Doering, Canton, MI (US); Michael John Cullen, Northville, MI (US); Tobias John Pallett, Point Cook (AU)

(73) Assignee: Ford Global Technologies, LLC, Dearborn, MI (US)

( * ) Notice: Subject to any disclaimer, the term of this patent is extended or adjusted under 35 U.S.C. 154(b) by 25 days.

(21) Appl. No.: 10/065,142

(22) Filed: Sep. 20, 2002

(51) Int. Cl.[7] ..... F02D 41/00

(52) U.S. Cl. ..... 123/396; 123/399; 701/103; 701/115

(58) Field of Search ..... 123/396, 399, 123/198 D, 198 DB, 198 DC; 701/103, 107, 115

(56) References Cited

U.S. PATENT DOCUMENTS 5,146,892 A 9/1992 Krampe et al.
5,235,951 A 8/1993 Taguchi et al.
5,370,094 A 12/1994 Sorg et al.
5,703,410 A * 12/1997 Maekawa ..... 290/40 C
5,755,201 A 5/1998 Knoss et al.
5,992,379 A 11/1999 Brüdigam et al.
6,182,635 B1 2/2001 Nishida
6,223,721 B1 5/2001 Bauer et al.
6,237,563 B1 * 5/2001 Froehlich et al. ..... 123/350
6,251,044 B1 6/2001 Streib
6,273,061 B1 8/2001 Hosoi
6,295,967 B1 10/2001 Weber et al.
6,367,462 B1 * 4/2002 McKay et al. ..... 123/568.21
6,581,565 B2 * 6/2003 Heslop et al. ..... 123/295

* cited by examiner

*Primary Examiner*—Mahmoud Gimie
*Assistant Examiner*—Hai Huynh
(74) *Attorney, Agent, or Firm*—Daly, Crowley & Mofford, LLP

(57) ABSTRACT

A system and method wherein a torque monitoring algorithm compares torque demand (i.e., driver-demanded torque computed primarily from acceleration pedal position), with two independent torque estimates (e.g., one estimated from throttle position and one estimated from mass airflow (MAF) to the intake manifold). If the maximum of the two actual torque estimates exceeds the driver-demanded torque, the monitoring algorithm logic intervenes in engine torque production (e.g., shuts off fuel to cylinders) and lights a service (wrench) light. In order to prevent, or minimize, unnecessary engine torque production intervention, reducing a torque demand signal to the throttle by a factor, such factor being a function of airflow meter load divided by throttle load.

12 Claims, 3 Drawing Sheets

METHOD AND SYSTEM FOR MINIMIZING TORQUE INTERVENTION OF AN ELECTRONIC THROTTLE CONTROLLED ENGINE

TECHNICAL FIELD

This invention relates to electronic throttle controlled engines and more particularly to systems and method for intervening in such throttle control in the event of an apparent fault in estimates of engine operating parameters used to control such throttle.

BACKGROUND AND SUMMARY OF INVENTION

As is known in the art, a torque monitor function is used for engines equipped with electronic throttle control. This function achieves a high level of safety by checking the desired engine torque, (i.e., driver demanded torque from, for example, a sensing of driver accelerator pedal position) with two independent measures of torque, for example, a throttle based (e.g., throttle position) estimate and an air-meter (i.e., Mass Air Flow, MAF) based method. If the air-meter based method calculates a torque that exceeds the driver demanded torque, the torque monitor function will intervene by one of several methods including shutting off fuel to cylinders.

The inventors have recognized that if a real failure has occurred, say due to a stuck open throttle, then this intervention is appropriate. However, if the intervention was due to other factors, like an air-meter which reads too high due to dirt, or a whole host of other reasons, then the intervention is obnoxious to the driver, and shutting off fuel to cylinders is probably not an appropriate control reaction to measurement errors. In such case, intervention should be prevented.

The general philosophy of intervention prevention is that if the vehicle behavior can be modified in a subtle manner not likely to be noticed by the driver in order to prevent monitor intervention (e.g., shutting off fuel to cylinders), then such modification is a more preferable choice. Even if the driver notices the control changes as a result of intervention modification by vehicle behavior modification in such a subtle manner, such intervention modification may still be a better control choice than an intervention which shuts off fuel to cylinders. So in the end intervention should be limited to real failures, as opposed to momentary misalignment of various calculations due to a number of inconsequential factors.

One known torque monitoring algorithm compares torque demand (i.e., driver-demanded torque computed primarily from acceleration pedal position), with two independent torque estimates (e.g., one estimated from throttle position and one estimated from mass airflow (MAF) to the intake manifold). If the maximum of the two actual torque estimates exceeds the driver-demanded torque, the monitoring algorithm logic intervenes in engine torque production (e.g., shuts off fuel to cylinders) and lights a service (wrench) light.

In accordance with the invention, in order to prevent, or minimize, unnecessary intervention, an adjustment is made to the driver-demanded torque. For example, driver-demanded torque is reduced by a factor based on the ratio of the two actual torque estimates thereby minimizing the cases where the monitor will intervene by, for example, shutting off fuel to cylinders.

In one embodiment, a method is provided for controlling intervention of an internal combustion engine having an electronically controlled throttle. The method includes comparing at least two independent estimates of torque with a commanded torque demand on the engine. If the maximum of the two independent estimates of torque exceeds the commanded torque demand, torque demand on the engine is potentially intervened. If the load as estimated from an airmeter is greater than the load estimated from the throttle, then the demand is reduced to prevent said potential intervention.

In one embodiment, if such comparison indicates the maximum of the two torque estimates exceeds the torque demand, potentially intervening in engine torque production, and, in order to prevent, or minimize, unnecessary engine torque production intervention, reducing a torque demand signal to the throttle by a factor, such factor being a function of airflow meter demand divided by throttle demand.

In accordance with another feature of the invention, a method for controlling intervention of an internal combustion engine is provided. The engine includes an electronically controlled throttle disposed in the airflow to an intake manifold of the engine and an airflow meter disposed in such airflow to the intake manifold of the engine. The engine has a torque demand input to the engine through an operator pedal. The torque demand increases as such pedal position increases and decreases as such pedal position decreases, such torque demand producing a signal fed to the electronically controlled throttle. The method includes comparing, measured throttle load with measured airflow load. If the measured airflow load is greater than the measured throttle load, calculating a factor tr_intprv_ml, where tr_intprv_ml is equal to F1'+(1−F1') P, where: F1' is a function of measured throttle load divided by measured airflow load and P=0 if pedal position is relatively low, 1 if pedal position exceed a predetermined relatively high pedal position, or a proportional intermediate value between 0 and 1 if the pedal position is between the relatively low and relatively high pedal positions and applying such calculated factor to the signal fed to the electronically controlled throttle. If the measured airflow load is less than the measured throttle load having the factor tr_intprv_ml equal to a value of 1.

With such method, if the air-meter reads higher than the throttle based estimate of air and torque, then the method simply closes the throttle until the air-meter is satisfied. It is judged that most drivers will not notice that they are getting slightly less torque at a given pedal position, and even if they notice will prefer this control action to an intervention. Further, if the driver still wishes higher torque than produced by the driver-demanded torque which has been reduced by the applied factor, the driver will merely demand more torque by increase accelerator pedal position. More particularly, at high pedal angles (i.e., the driver depresses the accelerator pedal to, or near, its maximum thereby demanding maximum torque), the method disables intervention completely. That is, if the driver is demanding close to maximum torque, then it doesn't make sense to monitor power greater than demand; the driver wants all the torque available. This override of intervention prevention is achieved in a smooth and continuous manner with the logic by blending the effect out over a range of pedal angle. The same blending is done to disable the monitor itself, using the same ramp versus pedal. However, if the throttle is stuck this method will not be able to prevent the intervention, which is appropriate.

The details of one or more embodiments of the invention are set forth in the accompanying drawings and the description below. Other features, objects, and advantages of the invention will be apparent from the description and drawings, and from the claims.

BRIEF DESCRIPTION OF DRAWINGS

Like reference symbols in the various drawings indicate like elements.

DETAILED DESCRIPTION

Figure 1:
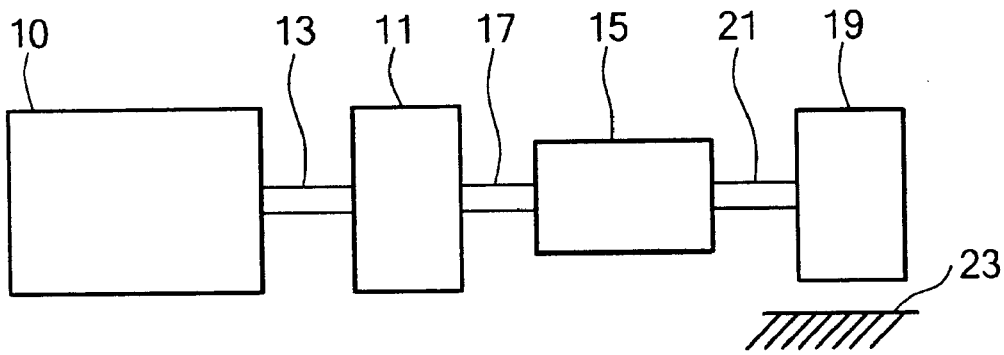
FIG. 1 is a block diagram of a vehicle illustrating various components related to the present invention.
Figure 2:
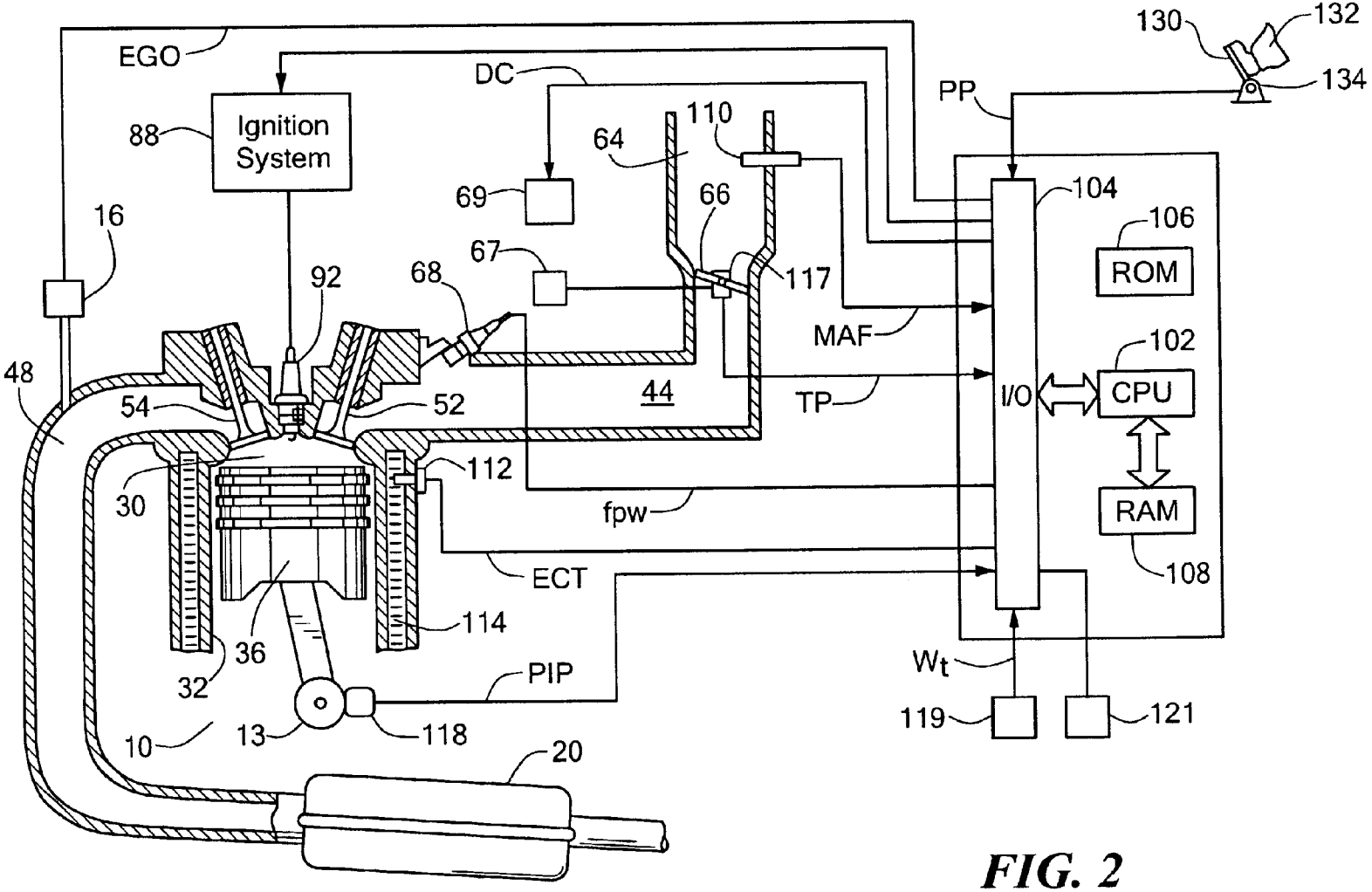
FIG. 2 is a block diagram of an engine system in accordance with the invention.

Referring to FIG. 1, internal combustion engine 10, further described herein with particular reference to FIG. 2, is shown coupled to torque converter 11 via crankshaft 13. Torque converter 11 is also coupled to transmission 15 via turbine shaft 17. Torque converter 11 has a bypass clutch (not shown) which can be engaged, disengaged, or partially engaged. When the clutch is either disengaged or partially engaged, the torque converter is said to be in an unlocked state. Turbine shaft 17 is also known as transmission input shaft. Transmission 15 comprises an electronically controlled transmission with a plurality of selectable discrete gear ratios. Transmission 15 also comprises various other gears, such as, for example, a final drive ratio (not shown).

Transmission 15 is also coupled to tire 19 via axle 21. Tire 19 interfaces the vehicle (not shown) to the road 23.

Internal combustion engine 10 comprising a plurality of cylinders, one cylinder of which is shown in FIG. 2, is controlled by electronic engine controller 12. Engine 10 includes combustion chamber 30 and cylinder walls 32 with piston 36 positioned therein and connected to crankshaft 13. Combustion chamber 30 communicates with intake manifold 44 and exhaust manifold 48 via respective intake valve 52 and exhaust valve 54. Exhaust gas oxygen sensor 16 is coupled to exhaust manifold 48 of engine 10 upstream of catalytic converter 20.

Intake manifold 44 communicates with throttle body 64 via throttle plate 66. Throttle plate 66 is controlled by electric motor 67, which receives a signal from ETC driver 69. ETC driver 69 receives control signal (DC) from controller 12. Intake manifold 44 is also shown having fuel injector 68 coupled thereto for delivering fuel in proportion to the pulse width of signal (fpw) from controller 12. Fuel is delivered to fuel injector 68 by a conventional fuel system (not shown) including a fuel tank, fuel pump, and fuel rail (not shown).

Engine 10 further includes conventional distributorless ignition system 88 to provide ignition spark to combustion chamber 30 via spark plug 92 in response to controller 12. In the embodiment described herein, controller 12 is a conventional microcomputer including: microprocessor unit 102, input/output ports 104, electronic memory chip 106, which is an electronically programmable memory in this particular example, random access memory 108, and a conventional data bus.

Controller 12 receives various signals from sensors coupled to engine 10, in addition to those signals previously discussed, including: measurements of inducted mass air flow (MAF) from mass air flow sensor 110 coupled to throttle body 64; engine coolant temperature (ECT) from temperature sensor 112 coupled to cooling jacket 114; a measurement of throttle position (TP) from throttle position sensor 117 coupled to throttle plate 66; a measurement of transmission shaft torque, or engine shaft torque from torque sensor 121, a measurement of turbine speed (Wt) from turbine speed sensor 119, where turbine speed measures the speed of shaft 17, and a profile ignition pickup signal (PIP) from Hall effect sensor 118 coupled to crankshaft 13 indicating an engine speed (N). Alternatively, turbine speed may be determined from vehicle speed and gear ratio.

Continuing with FIG. 2, accelerator pedal 130 is shown communicating with the driver's foot 132. Accelerator pedal position (PP) is measured by pedal position sensor 134 and sent to controller 12.

The CPU 102 is programmed to execute a torque monitoring algorithm and compares torque demand (i.e., driver-demanded torque computed primarily from acceleration pedal position), with two independent torque estimates (e.g., one estimated from throttle position and one estimated from mass airflow (MAF) to the intake manifold). If the maximum of the two actual torque estimates exceeds the driver-demanded torque, the monitoring algorithm logic intervenes in engine torque production (e.g., shuts off fuel to cylinders) and lights a service (wrench) light. In order to prevent, or minimize, unnecessary intervention, an adjustment is made to the driver-demanded torque. For example, driver-demanded torque is reduced by a factor based on the lower of the two actual torque estimates thereby minimizing the cases where the monitor will intervene by, for example, shutting off fuel to cylinders.

More particularly, if the air-meter reads higher than the throttle based estimate of air and torque, then the method simply closes the throttle until the air-meter is satisfied. It is judged that most drivers will not notice that they are getting slightly less torque at a given throttle, and even if they notice will prefer this control action to an intervention. Further, if the driver still wishes higher torque then produced by the driver-demanded torque which has been reduced by the applied factor, the driver will merely demand more torque by increase accelerator pedal position. More particularly, at high pedal angles (i.e., the driver depresses the accelerator pedal to, or near, its maximum thereby demanding maximum torque), the method disables intervention completely. That is, if the driver is demanding close to maximum torque, then it doesn't make sense to monitor power greater than demand; the driver wants all the torque available. This override of intervention prevention is achieved in a smooth and continuous manner with the logic by blending the effect out over a range of pedal angle. The same blending is done to disable the monitor itself, using the same ramp versus pedal. However, if the throttle is stuck this method will not be able to prevent the intervention, which is appropriate.

The process compares measured throttle load with measured airflow load. If the measured throttle load is greater than the measured airflow load, calculating a factor tr_intprv_ml, where tr_intprv_ml is equal to F1'+(1−F1') P, where: F1' is a function of measured airflow load divided by measured throttle load and P=0 if pedal position is relatively low, 1 if pedal position exceeds a predetermined relatively high pedal position, or a proportional intermediate value between 0 and 1 if the pedal position is between the relatively low and relatively high pedal positions and applying such calculated factor to the signal fed to the electronically controlled throttle. On the other hand, if the measured throttle load is less than the measured airflow load having the factor tr_intprv_ml equal to a value of 1.

Figure 3:
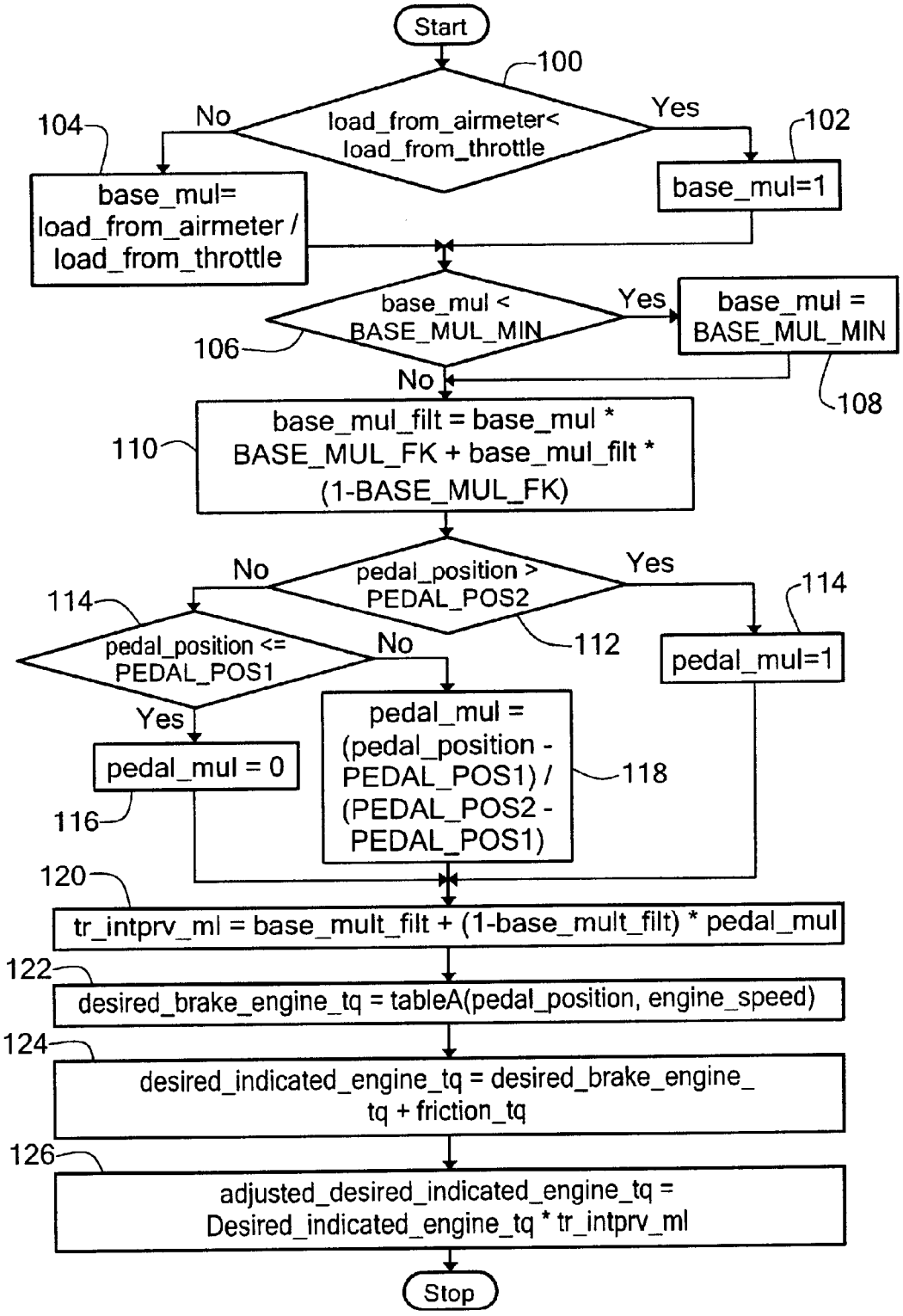
FIG. 3 is a flow diagram of a process used by the engine system of FIG. 2 in accordance with the invention.

Referring now to FIG. 3, the flow diagram of the process is shown in more detail.

As noted above, the process calculates a variable factor, tr_intprn_ml, which is applied later to driver demand torque. When this variable is less than 1.0 the driver demand will be lowered to satisfy the ETC monitor so cylinders will not be disabled.

In Step 100, if the load as measured in response to signals from the MAF meter is less than the load as measured from the sensed throttle position (i.e., IF (load_from_airmeter<load_from_throttle), a term. Base_mul=1 (Step 102). In such condition, the MAF will not indicate actual power is greater than demanded power so that no adjustment to driver demand required.

If, on the other hand in Step 100 it is determined that the load as measured in response to signals from the MAF meter is greater than the load as measured from the sensed throttle position, in Step 104, the term Base_mul=the load_from_airmeter divided by load_from_throttle.

The process now clips the base_mul value to a calibratable minimum. This allows the impact of intervention prevention on driveability to be controlled.

More particularly, in Step 106, base_mul<BASE_MUL_MIN, base_mul=BASE_MUL_MIN, Step 108, having typical values from 0.9 to 0.85.

Otherwise, in Step 110, the base_mul is filtered to prevent rapid changes and to minimize negative impact on driveability. (It is noted that in Step 106, if base_mul<BASE_MUL_MIN, base_mul=BASE_MUL_MIN, these values of BASE_MUL_MIN are also filtered in Step 110).

The filtering in Step 110, uses a calibratable value, BASE_MUL_FK, to selectively weight new values relative to old values of base_mul. This is known in the art as a filter constant. Alternately, a time constant could be used.

Here, the filtering used is:

base_mul_filt=base_mul*BASE_MUL_FK+base_mul_filt*(1−BASE_MUL_FK)

The process now calculates the adjustment to the above ratio based on pedal position. Note, at high pedal there is no such thing as power greater than demand, so the above ratio, Base_mul, is blended toward 1, indicating no adjustment, and the monitor is disabled.

Thus, in Step 112, if the current accelerator pedal position is greater than a second calibratible pedal point, POS2, (i.e., IF (pedal_position>PEDAL_POS2), a pedal multiplier factor pedal_mul is set equal to 1 (Step 114), i.e., pedal_mul=1.0 and no adjustment is made to driver demand at thus relatively high accelerator pedal position POS2.

On the other hand, if the current accelerator pedal position is less than the second calibratible pedal point, POS2 in Step 112, and if the current pedal_position is less than or equal to a small pedal position, POS1, (Step 114) the pedal_factor is made 0 (Step 116). That is, if the current pedal less than or equal to first calibratible pedal point POS1, pedal_mul=0.

On the other hand, if the current accelerator pedal position is less than the second calibratible pedal point, POS2 in Step 112, and if the current pedal_position is greater than the small pedal position, POS1, (Step 114) the pedal_factor is made equal to (pedal_position−PEDAL_POS1) divided by (PEDAL_POS2−PEDAL_POS1), in Step 118. That is, pedal_factor is linearly varied between 0 and 1 as the pedal travels between PEDAL_POS1 and PEDAL_POS2. Next, in Step 120, a factor tr_intprv_ml is calculated in accordance with:

Tr_intprv_ml=base_mul_filt+(1−base_mul_filt)*pedal_mul

Or, as noted above, tr_intprv_ml is equal to F1'+(1−F1')P, where: F1' is a function of measured throttle load divided by measured airflow load and P=0 if pedal position is relatively low, 1 if pedal position exceed a predetermined relatively high pedal position, or a proportional intermediate value between 0 and 1 if the pedal position is between the relatively low and relatively high pedal positions and applying such calculated factor to the signal fed to the electronically controlled throttle. If the measured airflow load is less than the measured throttle load having the factor tr_intprv_ml equal to a value of 1.

Next, in Step 122, a driver demanded brake engine torque is calculated from position and engine speed. More particularly, Desired_brake_engine_tq=DRIVER_DEMAND_TORQUE_LOOKUP_TABLE (pedal_position, engine_speed)

where: DRIVER_DEMAND_TORQUE_LOOKUP_TABLE is a function of pedal_position and engine_speed, the data in such table being determined a priori during product development.

Friction is added to form an indicated torque, the torque equivalent of the torque on top of the piston in Step 124. That is, Desired_indicated_engine_tq=desired_brake_engine_tq+friction_tq where:

friction tq is described in U.S. Pat. No. , 5,241,855, the entire subject matter thereof being incorporated herein by reference.

The process next (Step 126) applies the intervention prevention multiplier tr_intprv_ml to the calculation of airflow required to achieve a driver demand. If the airmeter is reading high, adjust the driver demand down so the monitor does not trip. More particularly, adjusted_desired_indicated_engine_tq=Desired_indicated_engine_tq*tr_intprv_ml This desired indicated torque is converted to a desired airflow and then a desired throttle using methods known in the art.

A number of embodiments of the invention have been described. Nevertheless, it will be understood that various modifications may be made without departing from the spirit and scope of the invention. Accordingly, other embodiments are within the scope of the following claims.

What is claimed is:

1. A method for controlling intervention of an internal combustion engine having an electronically controlled throttle, comprising:

comparing at least two independent estimates of torque with a commanded torque demand on the engine;

if the maximum of the two independent estimates of torque exceeds the commanded torque demand, torque demand on the engine is potentially intervened; and, if the load estimated from an air meter disposed in the path of air flow to the engine is greater than estimated load from throttle position, then the demand is reduced to prevent said potential intervention.

2. A method for controlling an electronic throttle of an internal combustion engine, such method comprising:

comparing torque demand with two independent torque estimates;

if such comparison indicates the maximum of the two torque estimates exceeds the torque demand, potentially intervening in engine torque production, and, in order to prevent, or minimize, unnecessary engine torque production intervention, reducing a torque demand signal to the throttle by a factor, such factor being a function of airflow meter estimated demand divided by throttle position estimated demand.

3. The method recited in claim 2 wherein the factor is equal to F1'+(1−F1')P, where: F1' is a function of measured throttle load divided by measured airflow load and P=0 if pedal position is relatively low, 1 if pedal position exceeds a predetermined relatively high pedal position, or a proportional intermediate value between 0 and 1 if the pedal position is between the relatively low and relatively high pedal positions and if the measured airflow load is less than the measured throttle load the factor equals a value of 1.

4. A method for controlling intervention of an internal combustion engine having an electronically controlled throttle disposed in the airflow to an intake manifold of the engine and an airflow meter disposed in such airflow to the intake manifold of the engine, such engine having a torque demand input to the engine through an operator pedal, such torque demand increasing as such pedal position increases and such torque demand decreasing as such pedal position decreases, such torque demand producing a signal fed to the electronically controlled throttle, such method comprising:

comparing, measured throttle load with measured airflow load; and if the measured airflow load is greater than the measured throttle load, calculating a factor tr_intprv_ml, where tr_intprv_ml is equal to F1'+(1−F1') P, where: F1' is a function of measured throttle load divided by measured airflow load and P=0 if pedal position is relatively low, 1 if pedal position exceeds a predetermined relatively high pedal position, or a proportional intermediate value between 0 and 1 if the pedal position is between the relatively low and relatively high pedal positions and applying such calculated factor to the signal fed to the electronically controlled throttle; and if the measured airflow load is less than the measured throttle load having the factor tr_intprv_ml equal to a value of 1.

5. An internal combustion engine system, comprising:

an electronically controlled throttle disposed in the airflow to an intake manifold of the engine;

an airflow meter disposed in such airflow to the intake manifold of the engine; an operator pedal:

a controller programmed to respond to a torque demand input to the engine through the operator pedal, such torque demand increasing as such pedal position increases and such torque demand decreasing as such pedal position decreases, such torque demand producing a signal fed to the electronically controlled throttle, such processor comparing at least two independent estimates of torque with a commanded torque demand on the engine; and if the maximum of the two independent estimates of torque exceeds the commanded torque demand, torque demand on the engine is potentially intervened; and, if the load estimated from an air meter disposed in the path of air flow to the engine is greater than estimated load from throttle position, then the demand is reduced to prevent said potential intervention.

6. An internal combustion engine system, comprising:

an electronically controlled throttle disposed in the airflow to an intake manifold of the engine;

an airflow meter disposed in such airflow to the intake manifold of the engine; an operator pedal;

a controller programmed to respond to a torque demand input to the engine through the operator pedal, such torque demand increasing as such pedal position increases and such torque demand decreasing as such pedal position decreases, such torque demand producing a signal fed to the electronically controlled throttle, such processor comparing torque demand with two independent torque estimates; if such comparison indicates the maximum of the two torque estimates exceeds the torque demand, potentially intervening in engine torque production, and, in order to prevent, or minimize, unnecessary engine torque production intervention, reducing a torque demand signal to the throttle by a factor, such factor being a function of airflow meter estimated demand divided by throttle position estimated demand.

7. The system recited in claim 6 wherein the factor is equal to F1'+(1−F1')P, where: F1' is a function of measured throttle load divided by measured airflow load and P=0 if pedal position is relatively low, 1 if pedal position exceeds a predetermined relatively high pedal position, or a proportional intermediate value between 0 and 1 if the pedal position is between the relatively low and relatively high pedal positions and if the measured airflow load is less than the measured throttle load the factor equals a value of 1 comparing at least two independent estimates of torque with a commanded torque demand on the engine; and if the maximum of the two independent estimates of torque exceeds the commanded torque demand, torque demand on the engine is potentially intervened; and, if the load estimated from an air meter disposed in the path of air flow to the engine is greater than estimated load from throttle position, then the demand is reduced to prevent said potential intervention.

8. An internal combustion engine system, comprising:

an electronically controlled throttle disposed in the airflow to an intake manifold of the engine;

an airflow meter disposed in such airflow to the intake manifold of the engine;

an operator pedal; and a controller programmed to respond to a torque demand input to the engine through the operator pedal, such torque demand increasing as such pedal position increases and such torque demand decreasing as such pedal position decreases, such torque demand producing a signal fed to the electronically controlled throttle, such processor:

comparing, measured throttle load with measured airflow load; and if the measured airflow load is greater than the measured throttle load, calculating a factor tr_intprv_ml, where tr_intprv_ml is equal to F1'+(1−F1')P, where: F1' is a function of measured throttle load divided by measured airflow load and P=0 if pedal position is relatively low, 1 if pedal position exceeds a predetermined relatively high pedal position, or a proportional intermediate value between 0 and 1 if the pedal position is between the relatively low and relatively high pedal positions and applying such calculated factor to the signal fed to the electronically controlled throttle; and if the measured airflow load is less than the measured throttle load having the factor tr_intprv_ml equal to a value of 1.

9. An article of manufacture having thereon:

computer code for controlling intervention of an internal combustion engine having an electronically controlled throttle, comprising:

code for comparing at least two independent estimates of torque with a commanded torque demand on the engine;

if the maximum of the two independent estimates of torque exceeds the commanded torque demand, torque demand on the engine is potentially intervened; and, if the load estimated from an air meter disposed in the path of air flow to the engine is greater than estimated load from throttle position, then the demand is reduced to prevent said potential intervention.

10. An article of manufacture having thereon:

code for comparing torque demand with two independent torque estimates;

if such comparison indicates the maximum of the two torque estimates exceeds the torque demand, potentially intervening in engine torque production, and, in order to prevent, or minimize, unnecessary engine torque production intervention, reducing a torque demand signal to the throttle by a factor, such factor being a function of airflow meter estimated demand divided by throttle position estimated demand.

11. The article of manufacture recited in claim 10 wherein the factor is equal to F1'+(1−F1') P, where: F1' is a function of measured throttle load divided by measured airflow load and P=0 if pedal position is relatively low, 1 if pedal position exceeds a predetermined relatively high pedal position, or a proportional intermediate value between 0 and 1 if the pedal position is between the relatively low and relatively high pedal positions and if the measured airflow load is less than the measured throttle load the factor equals a value of 1.

12. An article of manufacture having thereon:

code for controlling intervention of an internal combustion engine having an electronically controlled throttle disposed in the airflow to an intake manifold of the engine and an airflow meter disposed in such airflow to the intake manifold of the engine, such engine having a torque demand input to the engine through an operator pedal, such torque demand increasing as such pedal position increases and such torque demand decreasing as such pedal position decreases, such torque demand producing a signal fed to the electronically controlled throttle, comprising:

code for comparing, measured throttle load with measured airflow load; and if the measured airflow load is greater than the measured throttle load, calculating a factor tr_intprv_ml, where tr_intprv_ml is equal to F1'+(1−F1') P, where: F1' is a function of measured throttle load divided by measured airflow load and P=0 if pedal position is relatively low, 1 if pedal position exceeds a predetermined relatively high pedal position, or a proportional intermediate value between 0 and 1 if the pedal position is between the relatively low and relatively high pedal positions and applying such calculated factor to the signal fed to the electronically controlled throttle; and if the measured airflow load is less than the measured throttle load having the factor tr_intprv_ml equal to a value of 1.

* * * * *